United States Patent [19]

Heilmann

[11] 3,942,984

[45] Mar. 9, 1976

[54] PROCESS FOR BLEACH-FIXING CHROMOGENICALLY COLOR PHOTOGRAPHIC SILVER HALIDE MATERIAL

[75] Inventor: Max Heilmann, Cologne, Germany

[73] Assignee: AGFA-Gevaert Aktiengesellschaft, Leverkusen, Germany

[22] Filed: Mar. 12, 1973

[21] Appl. No.: 340,089

[30] Foreign Application Priority Data

Mar. 17, 1972 Germany ..... 2212905

[52] U.S. Cl. ..... 96/60 BF; 96/22; 96/55; 96/61 R

[51] Int. Cl.[2] .. G03C 5/32; G03C 7/16; G03C 7/00; G03C 5/38

[58] Field of Search ..... 96/22, 55, 60 BF, 61 R

[56] References Cited

UNITED STATES PATENTS

| | | | |
|---|---|---|---|
| 3,189,452 | 6/1965 | Bard et al. | 96/55 |
| 3,634,088 | 1/1972 | Cooley | 96/60 BF |
| 3,700,450 | 10/1972 | Cooley | 96/60 BF |

*Primary Examiner*—David Klein
*Assistant Examiner*—Alfonso T. Suro Pico
*Attorney, Agent, or Firm*—Connolly and Hutz

[57] ABSTRACT

Color film of the silver halide emulsion type is developed by a process which includes a bleach-fixing bath treatment to remove the silver image, followed by an oxidizing bath to restore to the dyes the color which they lost in the bleach-fixing bath. This oxidizing bath must contain an iron-III-complex of an amino polyacetic acid as the oxidizing agent, e.g. the sodium-salt of the iron-III-complex of ethylene diamine tetra-acetic acid.

7 Claims, No Drawings

PROCESS FOR BLEACH-FIXING CHROMOGENICALLY COLOR PHOTOGRAPHIC SILVER HALIDE MATERIAL

This invention relates to a process for bleach-fixing developed color photographic silver halide material, more particularly material of the kind in which dyes have been produced chromogenically by color-forming development.

In color-forming development, a silver image is formed in addition to the dye image. However, this silver image subsequently has to be removed. It is known that bleaching baths with an oxidizing effect can be used for this purpose. So-called bleach-fixing baths which are able both to oxidize the silver and also to dissolve the oxidized silver out of the layer, have proved to be particularly suitable for this purpose. In addition to a fixing agent, which is normally sodium or ammonium thiosulfate, these bleach-fixing baths also contain a weak oxidizing agent which is able to oxidize the silver without affecting the fixing agent. Iron-III- and cobalt-III-complexes or organic amino polyacetic acids, more particularly the sodium salt of the iron-III-complex of ethylene diamine tetra acetic acid, have proved to be suitable oxidizing agents. Reference is made in connection with these bleach-fixing baths to German Pat. No. 866,605.

Unfortunately, these bleach-fixing baths have certain disadvantages. Oxidation of the metallic silver by the weak oxidizing agent is accompanied by the formation of the corresponding iron-II- or cobalt-II-complexes, for example of the ethylene diamine tetra acetic acid.

These iron-II- and cobalt-II-complexes are powerful reducing agents. They are formed in immediate proximity to the dyes which are formed during chromogenic development and reduce them to a more or less considerable extent, depending upon the prevailing conditions and upon their chemical constitution. This reduction usually is accompanied by a decolorization of the dyes.

During the bleach-fixing operation, the reduced dyes normally begin to undergo re-oxidation which can continue during the subsequent rinsing and drying stages so that, in many cases, after the dyes have been dried, there is no further evidence of the intermediate reduction of the dyes.

However, this is not the case with color photographic materials that are richer in silver, for example with color reversal films. During bleaching, the high silver concentration present after total development of the color reversal film produces a large quantity of reduced iron or cobalt complex, with the result that heavy reduction of the dyes occurs and subsequent re-oxidation is not sufficient so that very little color density is left after the bleach fixing, rinsing and drying. For this reason, the material has to be treated with an oxidizing bath in order to reestablish the original color saturation.

Oxidizing baths which follow the bleach-fixing bath are known. According to German Auslegeschrift No. 1,202,638, corresponding to U.S. Pat. No. 3,189,452, for example, a potassium ferricyanide bath is used to oxidize incompletely bleached silver, the partly reduced dyes being re-oxidized at the same time. Unfortunately, this bath is attended by certain disadvantages. Its productivity is limited because the ferrocyanide formed during oxidation of the dyes is not reoxidized by the oxygen present in the surrounding atmosphere. In addition, inexpert use of this bath can result in speckle formation. The bath can have an adverse effect upon the stability of the dye image. Finally, its use involves problems because of the increasingly more stringent anti-pollution regulations which give rise to considerable difficulties when disposing of the bath.

Another oxidizing bath for re-oxidizing the dyes containing potassium persulfate as oxidzing agent (cf. H. Berger "Agfacolor" 6th Edition, 1962, page 262) has been used practically. The disadvantage of this bath is that it is not stable nor exactly inexpensive. It necessitates constant checking and regulation.

An after-treatment bath has now been found which is particularly suitable for re-oxidizing the reduced dyes, is distinguished by low costs and high productivity and hence by high economy and which does not have any of the disadvantages referred to above. This bath contains the iron-III-complex of an amino polyacetic acid as oxidizing agent.

Accordingly, the invention relates to a process for bleach-fixing chromogenically developed color photographic silver halide material and is characterized by the fact that after bleach fixing the developed color photographic material is treated with an aerated oxidation bath containing the iron-III-complex of an amino polyacetic acid as oxidizing agent.

The new process uses one of the operations which take place in the bleach-fixing bath itself after the silver-bleaching operation and the color-bleaching operation associated with it, namely re-oxidation of the reduced dyes by atmospheric oxygen, but catalytically accelerated in accordance with the invention by the iron-III-complex of certain organic complexing agents.

The oxidation bath consists primarily of the iron-III-complex of a complex-forming amino polyacetic acid, for example ethylene diamine tetra acetic acid. The following are examples of other suitable amino polyacetic acids: nitrilo tri-acetic acid, ethylenediamine tetraacetic acid, N-hydroxyethyl-ethylenediamine -N,N',N'-tri-acetic acid, di-ethylene triamine penta-acetic acid, 1,3-propylene diamine tetra-acetic acid, N-$\beta$-hydroxyethyl-1,3-propylene diamine tri-acetic acid, o-phenylene diamine tetra-acetic acid, 1,2-cyclohexylene diamine tetra-acetic acid.

In order to prevent discoloration of the color images through the formation of a colored iron complex of the cyan-forming coupler, small quantities of excess complexing agents, for example ethylenediamine tetra-acetic acid, are best added to the bath.

The pH-value of the bath is advantageously adjusted to between about 7 and 9, for example to 8, which can be done with phosphates, borates, acetates and similar buffering substances.

If this bath is vigorously aerated, an oxidizing after bath of almost unlimited productivity is obtained. The high productivity is explained by the fact that atmospheric oxygen, available in almost unlimited quantities, is used indirectly as the oxidizing agent. The iron-III-complex of the amino polyacetic acid acts so to speak as an oxygen-transfer agent. Since it is not consumed during the reaction, but instead, following reduction into the divalent complex, is re-oxidized to the trivalent complex by the atmospheric oxygen present, no exhaustion phenomena are observed in the oxidation bath according to the invention, but merely dilution under the effect of entrained water. However, entrained water does not result in disturbances over the processing cycle as a whole, even in the event of prolonged operation, because the, as it were, catalytically active oxidizing agent is always present in a large excess. Since the iron-III-complex of the amino polyacetic acid acts as it were catalytically, its concentration in the oxidizing after bath is not in the least critical. Accordingly, it can be varied within very wide limits. The complex could be used merely in catalytic quantities, although in this case oxidation takes too long. The upper limit to the concentration is imposed by the solubility of the iron-III-complex used. Concentrations of from 2 to 50 g, preferably from 10 to 20 g per liter, have proved to be effective in practice.

The foregoing also demonstrates the advanced nature of the oxidation bath according to the invention in relation to conventional oxidation baths which, because they are not oxidized by atmospheric oxygen, are quickly consumed and, hence, require constant checking and regeneration.

In general, not every iron-III-complex is suitable for the process according to the invention. The iron-III-cyanide complex for example is not suitable because, although it is an oxidizing agent, it is not reversibly regenerated by atmospheric oxygen after reduction. The green iron-III-complex of isopropanol-1,3-diamino tetra-acetic acid does not act as an oxidizing agent at all and, although the iron-III-complex of oxalic acid used in Belitzki's clearing agent can be regenerated by atmospheric oxygen, it causes excessive discoloration of the emulsion layers which cannot be eliminated even by the addition of excess oxalic acid.

The oxidation baths according to the invention can be prepared from the iron-III-complex compounds themselves, for example from the acid monosodium salt of the iron-III-complex of diethylene triamine penta-acetic acid (CHEL 330 Na H Fe, a product of Ciba-Geigy), from the sodium salt of the iron-III-complex of ethylene diamine tetra-acetic acid or from the acid iron-II-complex of ethylene diamine tetra-acetic acid (Ciba-Geigy's Sequestrene H 2 Fe). In the last of these three cases, the solution has to be aerated before use, resulting in formation of the iron-III-complex. When the fully oxidized iron-complex compounds are used, a small excess of complexing agents, whether of the complex used or of another complex, has to be added in the form of the free acid or one of its water-soluble salts in order to prevent discoloration of the color photographic material through formation of the iron-III-complex of the cyan-forming coupler.

It is also possible, however, initially to prepare the iron-III-complex in solution by reacting a simple iron salt, for example $Fe\ Cl_3 \cdot 6\ H_2O$ or $Fe\ SO_4 \cdot 7\ H_2O$ in aqueous solution with one of said amino polacetic acids, preferably in the form of its salts. Suitable salts include both the acid and also the neutral salts with alkali, ammonium or alkyl ammonium cations, for example mono-, di-, tri- or tetrasodium (or potassium) salts of ethylene diamine tetracetic acid, or the trimethyl ammonium or trihydroxy ethyl ammonium salt of one of the aforementioned acids. Salts of the amino polyacetic acids with other organic nitrogen compounds with a sufficiently basic effect, for example with morpholine, pyrrolidine or piperidine, are also suitable.

Dissociation of the iron-III-complexes of the amino poly-acetic acid can be suppressed by the addition of monodentate ligands, for example fluorides or thiocyanates, further increasing the oxidation capacity of the bath.

In addition to the aforementioned constituents, the oxidation baths can contain other substances in order to obtain special effects. Thus, it is possible by adding aldehydes, for example formaldehyde or glutaraldehyde in free or combined form, for example in the form of the bisulfite addition compounds to give the oxidation bath a hardening effect or to influence the swelling of the emulsion layers of the film by adding neutral salts, for example sodium sulfate.

The oxidation bath according to the invention can be incorporated with advantage into the processing cycle for all chromogenically developable color photographic materials based on silver halide after the bleach-fixing bath, if desired with brief intermediate rinsing in between.

Chromogenically developable color photographic materials are understood to comprise all color photographic materials wherein the image dyes are produced by development. The usual color-forming developers, such as aromatic compounds containing at least one primary amino group, preferably those of the p-phenylene diamine type as described in J. Amer. Chem. Soc. 73, 3100 (1951) are used for producing the dyes.

The bleach fixing treatment according to this invention is preferably performed in a bleach-fixing bath containing the iron-III-complex of an amino polyacetic acid as bleaching agent and an alkali metal thiosulfate as fixing agent. Particular reference is made in this connection to the article of M. Heilmann, "Uber das Agfaolor-Bleichfixierbad", in Mitteilungen aus den Forschungslaboratorien der Agfa, Leverkusen-Munchen, Vol I, page 256, published 1955 by Springer. But also other known bleach-fixing baths can be used although the particular advantage is established if a bleach-fixing bath having a considerably low oxidizing power, such as that mentioned above is used. Thus the danger of a bleaching fog is minimized even in cases where after the color development the material is not, or only for a short time, rinsed with water to remove residual color developer.

According to the present invention it is possible to obtain higher color densities as compared with the corresponding process without the oxidizing afterbath, especially in the case of the cyan dye. However, the particular advantage of the oxidation bath according to the invention is reflected in the processing of materials with a relatively high silver content in the form of silver halide or more than 2 g/m², for example in the processing of color reversal materials. In such cases, a strong bleaching bath with potassium ferricyanide as the bleaching oxidizing agent and a fixing bath are used in practice instead of the bleach-fixing bath.

A bleach-fixing bath alone would lead to inadequate cyan densities and the elimination of this disadvantage by a following oxidation bath of the conventional type involves other disadvantages as already mentioned.

Accordingly, the oxidation bath according to the invention enables the bleaching bath/fixing bath combination to be replaced by a bleach-fixing bath which is advantageous in many respects. The rinsing which precedes bleaching can be shortened from the usual 20 minutes or longer to 5 minutes because there is appreciably less danger of a color fog being formed through inadequate washing-out of color developers by virtue of the relatively weak oxidizing effect of the bleach-fixing bath.

The problems involved in the expensive, complicated regeneration of the bleaching bath with ozone or with potassium persulfate are also eliminated. Both in the bleach fixing bath and in the subsequent oxidation bath, straightforward aeration is all that is required to keep the baths fully operative. Last and by no means least, effluent pollution with cyanide ions does not occur in the process according to the invention.

EXAMPLE 1 several strips of a standard color reversal film containing, on a transparent substrate, a red-sensitized silver halide emulsion layer with a cyan-forming coupler, above this layer a green-sensitized silver halide emulsion layer with a magenta-forming coupler then a yellow-filter layer with colloidal silver and, above this layer, a blue-sensitive silver halide layer with a yellow-forming coupler, were exposed behind a continuous wedge, sujected to an initial black-and-white development in a hydroquinone-metol developer, subsequently rinsed, subjected uniformly to a diffuse second exposure to white light and to a color development, briefly rinsed and then dried. Strip 1 was then further processed in the usual way by being successively bleached for 5 minutes in a bleaching bath of the composition shown below and rinsed for 5 minutes. Strips 2 and 3 were rinsed for 2 minutes and then bleach-fixed for 20 minutes with vigorous agitation in a bleach-fixing bath with the composition shown below, resulting in heavy reduction of the magenta and, more particularly, of the cyan dye. Strip 2 was then rinsed for 5 minutes and dried in a stream of cold air. Strip 3 was rinsed for 5 minutes, treated for 5 minutes in oxidation bath number 1, rinsed for 5 minutes and then dried cold. The colour densities set out in Table 1 were obtained.

| Bath composition: | | |
|---|---|---|
| Bleaching bath: | potassium ferricyanide | 80 g |
| | potassium bromide | 20 g |
| | disodium phosphate anhydrous | 12 g |
| | made up with water to | 1000 ml |
| | pH adjusted with glacial acetic acid to 5.2 – 5.6 | |
| Bleach-fixing bath: | sodium salt of the iron-III-complex of ethylene diamine tetra-acetic acid | 40 g |
| | anhydrous sodium sulfite | 20 g |
| | ethylene diamine tetra-acetic acid | 1.5 g |
| | potassium dihydrogen phosphate | 10 g |
| | ammonium thiosulfate 80/20 (commercial product consisting of 80% of ammonium thiosulfate and 20% of sodium thiosulfate) | 200 g |
| | mercapto triazole | 2 g |
| | made up with water to | 1000 ml |
| | pH-value 6.0 | |
| Oxidation bath No.1: | sodium salt of the iron-III-complex of ethylene diamine tetra-acetic acid | 10 g |
| | tetra-sodium salt of ethylene diamine tetra-acetic acid commercial product with 30% active acid | 10 g |
| | made up with water to | 1000 ml |
| | pH-value adjusted with disodium phosphate to 8. | |

Table 1

| Strip No. | Treatment | Maximum density Yellow | Magenta | Cyan |
|---|---|---|---|---|
| 1 | standard (with bleaching bath and fixing bath) | 3.6 | 3.3 | 3.6 |
| 2 | with bleach-fixing bath without oxidation bath | 3.4 | 2.9 | 2.0 |
| 3 | with bleach-fixing bath with oxidation bath No.1 | 3.4 | 3.2 | 3.4 |

Strip 1 shows the maximum color densities of the reversal film treated in the usual way with a postassium-ferricyanide bleaching bath. Strip 2, which was only treated with bleach-fixing bath, shows much lower color densities for magenta and cyan. The original color densities are restored by the after-treatment with the oxidation bath (strip 3).

When the bleach-fixing bath is used, the high color densities can only be obtained by an after-treatment with an oxidation bath. The dyes reduced in the bleach-fixing bath cannot be re-oxidized either by vigorous aeration of the bleach-fixing bath or by vigorous aeration of the water over a treatment time of 15 minutes.

EXAMPLE 2

A stock solution containing per liter 3/100 mol (=8.1 g) of crystallized iron-III-chloride $FeCl_3 . 6 H_2O$, was prepared and then various baths were completed by the addition of 4/100 mol or 7/100 mol respectively of complexing agent to the following oxidation baths.

| Oxidation bath | complexing agent | molecular weight | g/l |
|---|---|---|---|
| No. 2 | ethylene diamine tetra-acetic acid | 292 | 11.76 |

-continued

| Oxidation bath | complexing agent | molecular weight | g/l |
|---|---|---|---|
| 3 | nitrilo tri-acetic acid | 191 | 7.64 |
| 4 | nitrilo tri-acetic acid | 191 | 13.37 |
| 5 | diethylene triamine penta-acetic acid | 393 | 15.7 |
| 6 | N-hydroxyethyl-ethylene diamine tri-acetic acid-3 Na in the form of a 41% solution | 344 | 33.6 |

The baths are then adjusted with disodium phosphate to pH 8.

Strips of a standard color reversal film which had been exposed, subjected to an initial black-and-white development, to a second exposure and then to color development, as described in Example 1, were bathed for 15 minutes in a bleach-fixing bath of the specified composition, rinsed for 5 minutes, subsequently treated for 5 minutes in one of the aforementioned vigorously aerated oxidation baths, rinsed for 5 minutes and then dried. The results are set out in Table 2.

with a potassium ferricyanide bleaching bath of the specified composition, rinsed, fixed in a neutral fixing bath and then thoroughly rinsed, treated with a wetting agent and dried.

EXAMPLE 4

2 × 400 ml of almost totally exhausted oxidation baths were prepared under nitrogen from 3.34 g of $FeSO_4 \cdot 7 H_2O$ and 4.7 g of ethylene diamine tetra-acetic acid in one case and from 41 g of potassium ferrocyanide (cryst.) in the other. Following adjustment of the pH-value to 8, the first bath corresponded to oxidation bath No. 2 (Example 2) in regard to its concentration of iron and complexing agent, but not in regard to its oxidising power, whilst the other bath corresponded to the bleaching bath of Example 1 containing 80g of potassium ferricyanide per liter.

As was expected, these baths were not able to oxidize under nitrogen and, in a practical test, gave identical, totally useless results. If these baths are aerated for 15 minutes before use, the divalent iron in the first bath oxidizes, accompanied by a change in color to reddish-brown, its pH-value rising slightly to around 8.3, whilst the potassium ferrocyanide bath retains its pale yellow color.

Table 2

| oxidation after-bath | maximum density yellow | magenta | cyan | Gradation γ 1 a) yellow | magenta | cyan | γ 2 b) yellow | magenta | cyan |
|---|---|---|---|---|---|---|---|---|---|
| none | 3.5 | 2.8 | 2.0 | 1.48 | 1.28 | 1.02 | 1.85 | 1.50 | 1.06 |
| 2 | 3.7 | 3.2 | 3.6 | 1.57 | 1.40 | 1.48 | 1.90 | 1.80 | 2.12 |
| 3 | 3.7 | 3.1 | 2.8 | 1.55 | 1.32 | 1.28 | 1.8 | 1.68 | 1.55 |
| 4 | 3.7 | 3.1 | 3.2 | 1.55 | 1.35 | 1.38 | 1.88 | 1.75 | 1.90 |
| 5 | 3.7 | 3.2 | 3.6 | 1.60 | 1.40 | 1.42 | 1.85 | 1.78 | 2.10 |
| 6 | 3.6 | 3.0 | 2.6 | 1.54 | 1.30 | 1.20 | 1.82 | 1.60 | 1.48 |
| Potassium ferri-cyanide bleaching bath | 3.7 | 3.2 | 3.6 | 1.60 | 1.41 | 1.40 | 1.95 | 1.85 | 2.15 |

a) 1 is the gradient of the secant through the curve point 0.2 over fogging and the curve point P 0.65 exposed more weakly by 0.65 log. It-units.

b) 2 is the gradient of the secant through the curve point $P_{0.65}$ and the curve point $P_{1.3}$ exposed more weakly by another 0.65 log. It-units.

Table 2 shows that both the maximum density of the individual image dyes and also the gradation of the dye layers of the film bleached with potassium ferricyanide are restored by an after-treatment with an oxidation bath of the kind in question.

EXAMPLE 3

As in Example 1, sensitometer strips of a standard color reversal film are exposed, subjected to a first development in a hydroquinone-metol developer, rinsed, subjected to a second exposure and then to color development and finally rinsed. The strips are then bleach-fixed for 10 to 20 minutes in a bleach-fixing bath of the composition specified, the bath advantageously being agitated with nitrogen. After intermediate rinsing for 5 minutes, the strips are treated for 5 minutes with an oxidation bath of the specified composition, a vigorous stream of air being passed through the bath. The strips of film are then finally rinsed, treated with a wetting-agent bath, advantageously with a little formalin added to it, and dried.

Films which are no different from normally processed films are obtained in this way. Following the second development, normally processed films would have to be rinsed for 20 minutes, treated for 5 minutes If a strip of standard color reversal film (Agfacolor CT 18) treated beforehand with bleach-fixing bath is bathed in these baths in the presence of air, the first bath develops its full activity, whilst the second bath gives the same useless result as before under nitrogen. The results are shown in Table 3.

Table 3

| After-treatment with | maximum density Yellow | magenta | cyan |
|---|---|---|---|
| iron-II-ethylene di-amine tetra-acetic acid under nitrogen | 3.6 | 2.6 | 0.7 |
| dito after contact with and in the presence of air | 3.6 | 3.3 | 3.3 |
| potassium ferrocyanide under nitrogen | 3.6 | 2.6 | 0.8 |
| potassium ferrocyanide after contact with and in the presence of air | 3.6 | 2.7 | 1.0 |
| for completion: vented bath with only 12.5 g/l of potassium ferrocyanide pH 8 | 3.6 | 2.6 | 0.8 |

I claim:

1. A process of producing colored photographic images from a color photographic silver halide material containing at least 2 grams of silver halide per square meter by imagewise exposure and color development wherein the silver image formed by color development from the silver halide emulsion is oxidized and subsequently removed through the use of a bleach-fixing bath, said silver oxidation being accompanied by reduction of the dyes formed chromogenically during the color development, and wherein the reduced dyes are then reoxidized to restore their original color, wherein the improvement comprises in the reoxidation method the bleach-fixing bath is followed by treatment of the film with an aerated oxidation bath containing an effective amount of the iron-III-complex of an amino polyacetic acid selected from the group consisting of nitrilo tri-acetic acid, ethylenediamine tetra-acetic acid, N-hydroxyethyl-ethylene-diamine -N,N',N'-tri-acetic acid, diethylene triamine penta-acetic acid, 1,3-propylene diamine tetra-acetic acid, N-β-hydroxy-ethyl-1,3-propylene diamine tri-acetic acid, o-phenylene diamine tetra-acetic acid, and 1,2-cyclohexylene diamine tetra-acetic acid.

2. The process of claim 1 wherein the oxidation bath is aerated before the treatment.

3. The process of claim 1 wherein the oxidation bath is aerated during said treatment.

4. The process of claim 1 wherein the oxidation bath is aerated before and during said treatment.

5. The process of claim 1 wherein in addition to the iron-III-complex of the amino polyacetic acid, the oxidation bath contains an additional quantity of the same or a different amino polyacetic acid.

6. The process of claim 1 wherein the oxidation bath additionally contains formaldehyde, glutaraldehyde, or the bisulfite addition compound of one of said aldehydes.

7. The process of claim 1 wherein said color photographic material after imagewise exposure and before the bleach-fixing treatment is subjected first to an initial black-and-white development and then a uniform second exposure and color development.

* * * * *